US005235723A

United States Patent [19]

Wallis

[11] Patent Number: 5,235,723

[45] Date of Patent: Aug. 17, 1993

[54] BIASING MECHANISM

[75] Inventor: Shirley D. Wallis, Kaniva, Australia

[73] Assignee: Erica Gem Pty. Ltd., Victoria, Australia

[21] Appl. No.: 850,860

[22] Filed: Mar. 13, 1992

[30] Foreign Application Priority Data

Mar. 13, 1991 [AU] Australia ..... PK5057

[51] Int. Cl.[5] ..... E05F 1/08

[52] U.S. Cl. ..... 16/78; 16/71; 16/80; 49/404

[58] Field of Search ..... 52/1, 19, 58; 49/386, 49/404; 187/55, 56; 16/71, 72, 78, 80, DIG. 11

[56] References Cited

U.S. PATENT DOCUMENTS 2,573,160 10/1951 Norman ..... 16/80
3,017,721 1/1962 Wasserman .
3,913,266 10/1975 Smith .

FOREIGN PATENT DOCUMENTS 102706 12/1937 Australia .
4178822 3/1991 European Pat. Off. .
2919116 11/1975 Fed. Rep. of Germany .
2529477 1/1977 Fed. Rep. of Germany .
898117 4/1945 France .

*Primary Examiner*—W. Donald Bray
*Attorney, Agent, or Firm*—Oliff & Berridge

[57] ABSTRACT

The invention provides a biasing device for biasing a movable first structure to a position relative to a second structure, said biasing device includes a connection mechanism for interconnecting said first and second structures, said connection mechanism including at least one motion reducing mechanism; and extensible and/or compressible biasing means for providing a biasing force;

the biasing means is connected between said first or second structure and said motion reducing mechanism so that the length of extension or compression of said biasing means is less than the movement of said first structure relative to said second structure.

12 Claims, 2 Drawing Sheets

BIASING MECHANISM

This invention relates to biasing devices in general, and is particularly, although not exclusively, concerned with devices for biasing the position of doors or windows and sliding door or window units incorporating biasing devices. The biasing device according to the present invention is especially suitable for use in sliding screen door and windows and it will be convenient to hereinafter describe the invention with reference to that type of application.

BACKGROUND OF THE INVENTION

Coiled springs have long been used to provide self closing mechanisms for various light weight household doors such as fly wire doors, hinged gates etc. A coiled spring is connected between the gate post and a point on the gate away from the hinged edge so that on opening the gate the spring stretches around the hinged edge, thereby providing a biasing force which acts to close the gate. This type of self closing mechanism is not readily adaptable to sliding doors since the spring is required to stretch the full distance moved by the door. This may cause over extension and deformation of the spring and can result in an excessive closing force being applied to the door in the fully opened position.

Pneumatic cylinder/piston devices are normally used to provide self closing mechanisms for heavier doors. These cylinder/piston devices can be expensive to produce and suffer from the disadvantage that the biasing force is dependent on the pressure in the cylinder and therefore dependent on the surrounding temperature.

It is an object of the present invention to provide a biasing device in which the amount of extension or compression of the means providing the biasing force is less than the relative movement of the structures being biased.

BRIEF SUMMARY OF THE INVENTION

Accordingly the invention provides a biasing device for biasing a movable first structure to a position relative to a second structure, said biasing device including:

connection means for interconnecting said first and second structures, said connection means including at least one motion reducing mechanism; and extensible and/or compressible biasing means for providing a biasing force;

wherein said biasing means is connected between said first or second structure and said motion reducing mechanism so that the length of extension or compression of said biasing means is less than the movement of said first structure relative to said second structure.

The invention also provides a sliding door or window unit incorporating such a biasing device.

The movable first structure may be any structure movable relative to a second structure. The second structure may itself be movable. In a preferred embodiment the first structure is a door, window or drawer. In a particularly preferred embodiment the first structure is a sliding panel such as a sliding door, window, flyscreen, security door or any other type of sliding panel.

The second structure may be a fixed structure such as a frame for a door or window, the body of a chest of drawers or filing cabinet, a wall, a frame for supporting the biasing device, a frame supporting the first structure or any other type of fixed structure. It is envisaged that the second structure may also be a movable structure such as a door, window etc.

The biasing means may be any means capable of being extended or compressed to provide the force for biasing the position of the first structure relative to the second structure. Examples of suitable biasing means would be known to a person skilled in the art and these would include various springs such as coiled springs, pneumatic cylinder/piston arrangements, lengths of resilient material such as rubber or other elastic material, etc. It is preferred that the biasing means includes a coiled spring which may be an extendible coiled spring or a compressible coiled spring. The compressible coiled spring is preferably located inside a housing such as a cylindrical housing with means provided at one or both ends of the cylinder for transferring a compressive force to the coiled spring. In a most preferred embodiment the biasing means includes an extensible metal coiled spring.

The motion reducing mechanism may be any mechanism capable of reducing linear motion. Examples of suitable motion reducing mechanisms include full pantographs and half pantographs. Preferably the motion reducing mechanism is of the full pantograph-type including a series of elongate members pivotably linked together in a scissors-like arrangement. The elongate members may be made of any suitable material such as steel, plastic, nylon, aluminium etc. Preferably the elongate members are plate-like. In a particularly preferred embodiment the motion reducing element comprises a series of elongate metal plates which are pivotably linked to each other through the centre of each plate and through both ends of each plate to form an expandible and contractible diamond lattice, the number and size of the elongate plates and number of diamonds in the lattice being chosen to suit the particular application. The plates may be connected by any means which allows the plates to pivot with respect to one another allowing the lattice to expand and contract. In this regard pop rivets are especially suitable.

In addition to the motion reducing mechanism the connection means may also include means for making the necessary connections between the motion reducing mechanism and the first and second structures. The motion reducing mechanism may be connected to the first and second structures via elongate bars or plates or may be directly connected to the first and second structures. Other means for connecting the motion reducing mechanism to the first and second structures would be evident to a person skilled in the art.

The motion reducing element may be self supporting i.e. supported only by connection to the first and second structures and the connection means or auxillary support may be provided by wheels attached along the length of the pantograph-type mechanism, the wheels being free to move along a supporting guide as the pantograph extends and contracts.

The biasing means is connected between either the first structure or the second structure and the motion reducing mechanism so that the length of extension or compression of the biasing means is less than the movement of the first structure relative to the second structure. The exact manner of connection of the biasing means will depend on the amount of motion reduction required and whether the biasing force is produced by extension or compression of the chosen biasing means. In a preferred embodiment the positioning of the biasing means is adjustable to allow adjustment of the biasing force to suit the particular application. This may be achieved by providing a number of connection points on either the first or second structure or a number of connection points on the motion reducing mechanism. In another embodiment the first or second structure is provided with a slot along which the connection point may be adjusted.

In a further embodiment of the invention the connection means further includes an adjustment component for adjusting the position of the motion reducing mechanism relative to the first or second structures. This adjustment component may include an elongate member being pivotably connected at one end thereof to the connection means and pivotably connected at an opposing end thereof to the first structure and a second biasing means connected between the elongate member and the first structure. This adjustment component acts to bias the position of the first structure relative to the second structure while the motion reducing mechanism is in a substantially locked state. The second biasing means may be any extensible or compressible biasing means as described above. In a preferred embodiment the second biasing means includes a spring.

BRIEF DESCRIPTION OF THE DRAWINGS

To facilitate an understanding of the invention reference is made to the accompanying drawings which illustrate some of the preferred features. However it is to be understood that the description following is illustrative only and should not be taken in any way as a restriction of the generality of the invention described above.

DETAILED DESCRIPTION

Figure 1:
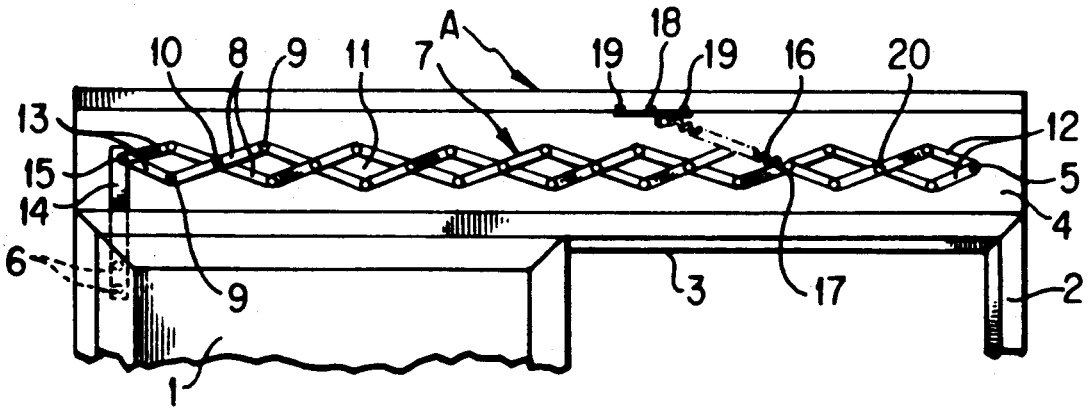
FIG. 1 is a rear view of a sliding window and window support in which the door is biased in a closed position by biasing mechanism according to a first embodiment of the present invention.

In the preferred arrangement shown in FIG. 1 the screen window 1 is biased in a closed position by a biasing mechanism A. The sliding screen window is supported in a frame 2. The frame 2 includes a guide 3 for guiding the movement of the sliding window. Attached to the wall above the window frame is a support casing 4 for supporting the biasing mechanism. This casing also acts to hide the biasing mechanism from view.

The biasing mechanism A is attached to the casing 4 with a nut and bolt 5. The other end of the biasing mechanism is attached to the screen window 1 with nuts and bolts 6.

The biasing mechanism A includes a pantograph 7. The pantograph consists of a series of elongate flat metal plates 8 which are pivotably linked together by pop rivets at ends 9 and centre 10 to form a scissors-like arrangement appearing as a series of diamonds 11. The pantograph is pivotably linked to a pair of shorter flat elongate plates 12 which are pivotably bolted to the casing 4. The other end of the pantograph is pivotably attached to a pair of short elongate plates 13 which are themselves pivotably attached to a longer elongate plate 14 by means of a nut and bolt 15. This longer elongate plate is attached to the screen window by a pair of bolts 6.

An extensible spring 16 is attached to a rivet 17 on the pantograph at one end while the other end is attached to the casing 4 using a nut and bolt 18. Two further holes 19 are provided in the casing 4 to provide alternative connection points for the end of the spring, thereby allowing adjustment of the biasing force. The strength of the biasing force may also be adjusted by attaching the spring to different positions on the pantograph i.e. at position 20 at which point motion is reduced further than at the position of rivet 17.

Figure 2:
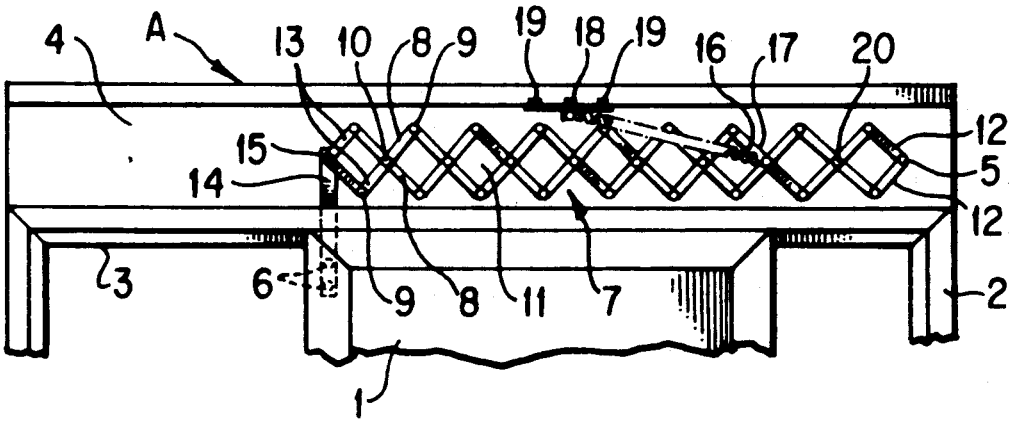
FIG. 2 is a rear view of the sliding window and window support shown in FIG. 1 in a partially open condition.
Figure 3:
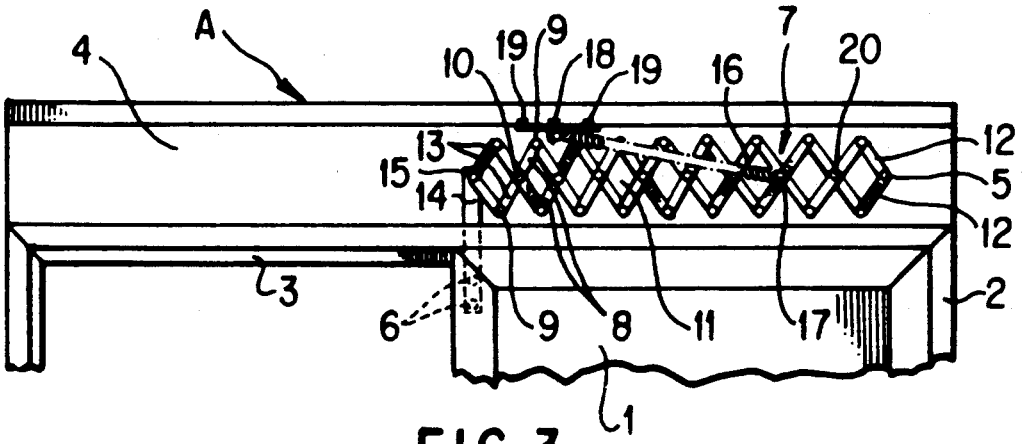
FIG. 3 is a rear view of the sliding window and window support shown in FIG. 1 in a fully open condition.

FIG. 2 shows the screen window in a half open position while FIG. 3 shows the screen window in a fully open position. As the window is opened the pantograph 7 compresses causing extension of the spring 16. However it can be seen from FIGS. 1 to 3 that the extension of the spring is much less than the movement of the screen window 1.

Figure 4:
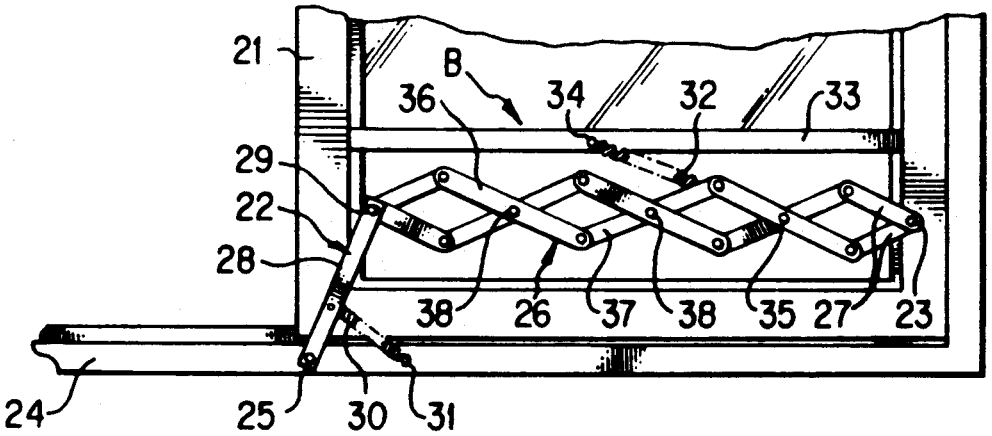
FIG. 4 is a rear view of a sliding door and door support in which the door is biased in a closed position by a biasing mechanism in accordance with a second embodiment of the invention which further includes and adjustment component.
Figure 5:
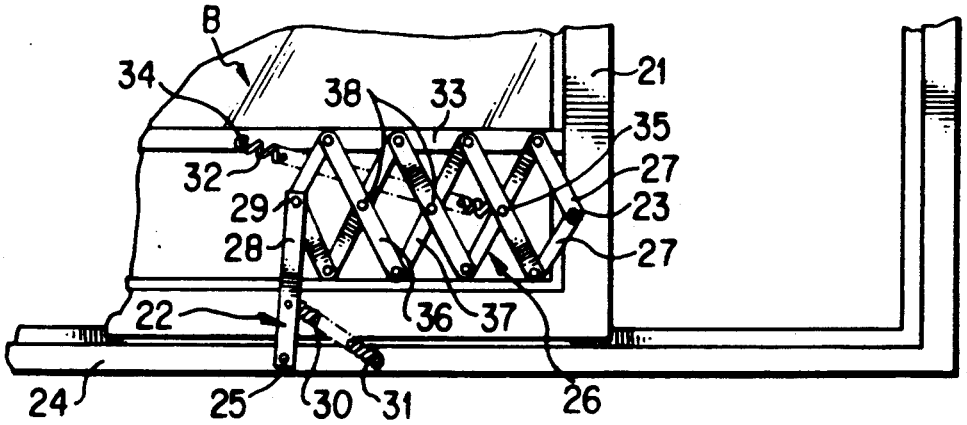
FIG. 5 is a rear view of the door shown in FIG. 4 in a partially open condition.
Figure 6:
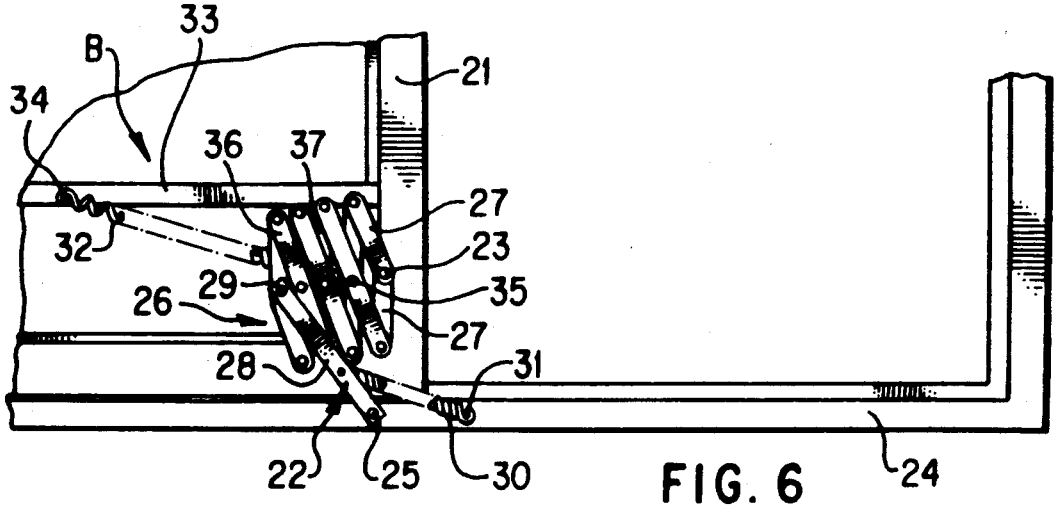
FIG. 6 is a rear view of the door when in FIG. 4 in a fully open condition.

FIGS. 4 to 6 show a door 21 biased in a closed position with a biasing mechanism B which includes an adjustment component 22.

One end of the pantograph 26 is pivotably connected to the door via a pair of short elongate plates 27 by a rivet 23. The other end of the pantograph is pivotably connected to two short elongate plates which are pivotably connected to an elongate plate 28 via rivet 29. The other end of the elongate plate is connected to the door frame 24 by rivet 25. A spring 30 is connected between the elongate plate 28 and the door frame 24. The spring is connected to the door frame via a rivet 31.

A spring 32 is connected between an elongate support 33 attached to the door 21 and the pantograph 26 via rivets 34 and 35.

The pantograph 26 depicted in FIGS. 4 to 6 comprises elongate plates 37 which pass through and are pivotably connected to pairs of elongate juxtaposed plates 36 via rivets 38.

FIG. 5 shows the door in a partially opened condition in which the pantograph 26 is in a contracted state causing extension of the spring 32. The elongate plate 28 has moved to an almost upright position causing a small extension of the spring 30.

FIG. 6 shows the door 21 in a fully open condition. When the pantograph 26 reaches a substantially locked state the further movement of the door 21 is biased by the tension in the spring 30. This allows the door to be pushed further than contraction of the pantograph 26 would allow.

The present invention provides a simple mechanism for biasing the position of two structures relative to one another. Since the length of extension or compression of the biasing means is reduced by the action of the motion reducing element the biasing force is much more uniform. The biasing mechanism according to the present invention allows a relatively short biasing means or spring to be used to bias the position of a movable structure over a substantial range.

Finally it is to be understood that various alterations, modifications or additions may be introduced into the biasing mechanism and arrangement of parts previously described without departing from the spirit or ambit of the invention.

I claim:

1. A biasing device for biasing a sliding panel to a position relative to a fixed structure, said biasing device including:

connection means for interconnecting said sliding panel and said fixed structure, said connection means including a pantograph-type mechanism; and extensible and/or compressible biasing means for providing a biasing force, wherein said biasing means is connected between said pantograph-type mechanism and one of said sliding panel and said fixed structure so that a length of extension or compression of said biasing means is less than movement of said sliding panel relative to said fixed structure.

2. A biasing device according to claim 1, wherein said pantograph-type mechanism includes a series of elongate members pivotably linked together in a scissors-like arrangement.

3. A biasing device according to claim 1, wherein said biasing means includes a spring.

4. A biasing device according to claim 1, wherein said connection means further includes an adjustment component for adjusting the position of the pantograph-type mechanism relative to the sliding panel or the fixed structure.

5. A biasing device according to claim 4, wherein said adjustment component includes:

an elongate member interconnecting the connection means and said sliding panel, said elongate member being pivotably connected at one end thereof to the connection means and pivotably connected at an opposing end thereof to said sliding panel; and a second biasing means connected between the elongate member and the fixed structure.

6. A biasing device according to claim 4, wherein said adjustment component includes:

an elongate member interconnecting the connection means and said sliding panel, said elongate member being pivotably connected at one end thereof to the connection means and pivotably connected at an opposing end thereof to said fixed structure; and a second biasing means connected between the elongate member and the fixed structure.

7. A biasing device according to claim 5, wherein said second biasing means includes a spring.

8. A biasing device according to claim 6, wherein said second biasing means is a spring.

9. A biasing device according to claim 1, wherein said sliding panel is a door and said fixed structure is a frame slidably supporting said sliding panel.

10. A biasing device according to claim 1, wherein said sliding panel is a window panel and said fixed structure is a frame slidably supporting said sliding panel.

11. A biasing device according to claim 4, wherein said sliding panel is a door and said fixed structure is a frame slidably supporting said sliding panel.

12. A biasing device according to claim 4, wherein said sliding panel is a window panel and said fixed structure is a frame slidably supporting said sliding panel.

* * * * *

UNITED STATES PATENT AND TRADEMARK OFFICE

CERTIFICATE OF CORRECTION

PATENT NO. : 5,235,723

DATED : August 17, 1993

INVENTOR(S) : Shirley D. Wallis

It is certified that error appears in the above-indentified patent and that said Letters Patent is hereby corrected as shown below:

Column 6:

Claim 5, line 7, change "fixed structure" to --sliding panel--.

Claim 6, line 11, change "sliding panel" to --fixed structure--.

Signed and Sealed this

Eleventh Day of July, 1995

*Attest:*

Bruce Lehman

BRUCE LEHMAN

*Attesting Officer*

*Commissioner of Patents and Trademarks*